US009243393B1

(12) United States Patent
Tidwell

(10) Patent No.: US 9,243,393 B1
(45) Date of Patent: Jan. 26, 2016

(54) DRAIN ASSEMBLY FOR INDUSTRIAL SINK

(71) Applicant: Atlanta Kitchen Equipment, Inc., Douglasville, GA (US)

(72) Inventor: Sam M. Tidwell, Douglasville, GA (US)

(73) Assignee: Atlanta Kitchen Equipment, Inc., Douglasville, GA (US)

( * ) Notice: Subject to any disclaimer, the term of this patent is extended or adjusted under 35 U.S.C. 154(b) by 0 days.

(21) Appl. No.: 14/673,331

(22) Filed: Mar. 30, 2015

(51) Int. Cl.
*E03C 1/12* (2006.01)
*E03C 1/23* (2006.01)

(52) U.S. Cl.
CPC ..... *E03C 1/2302* (2013.01)

(58) Field of Classification Search
CPC .. E03C 1/23; E03C 1/2303; E03C 2001/2314
USPC ..... 4/679, 682, 685, 688–692
See application file for complete search history.

(56) References Cited

U.S. PATENT DOCUMENTS

| | | | | |
|---|---|---|---|---|
| 203,745 | A * | 5/1878 | Leverty | 4/681 |
| 1,760,659 | A | 5/1930 | Pasman | |
| 1,904,423 | A * | 4/1933 | Eby | 138/30 |
| 2,699,555 | A | 1/1955 | Green | |
| 3,010,118 | A | 11/1961 | Isherwood | |
| 3,314,085 | A | 4/1967 | Minella | |
| 3,499,628 | A | 3/1970 | Schwartz | |
| 6,058,526 | A | 5/2000 | Parisi et al. | |
| 6,138,297 | A | 10/2000 | Harris et al. | |
| 6,584,625 | B2 | 7/2003 | Weaver | |
| 6,609,259 | B2 | 8/2003 | Cantrell | |
| 8,214,934 | B2 | 7/2012 | Sullivan | |
| 8,316,474 | B2 | 11/2012 | Kang | |
| 2012/0255117 | A1 * | 10/2012 | Childs et al. | 4/650 |
| 2014/0075662 | A1 | 3/2014 | Gayoso | |

* cited by examiner

*Primary Examiner* — Huyen Le
(74) *Attorney, Agent, or Firm* — Morris, Manning & Martin, LLP; Daniel E. Sineway, Esq.; Lee Strasburger, Esq.

(57) ABSTRACT

A drain assembly for an industrial sink that is seamlessly attached to a basin of a sink. In one embodiment, the drain assembly comprises a drain tube, drain stopper, gasket, clamp, and lever. According to one embodiment, the drain assembly is seamlessly welded to the basin of the sink so that the drain assembly and sink form one continuous unit. The drain assembly allows for external (to the sink) operation of the drain assembly via the use of a lever that is attached to the drain stopper, wherein moving the lever seals and opens the drain assembly. In one embodiment, the drain stopper is spherically-shaped with spherical wedges cut out of the top to form a disc-shaped handle.

17 Claims, 6 Drawing Sheets

DRAIN ASSEMBLY FOR INDUSTRIAL SINK

TECHNICAL FIELD

The present disclosure generally relates to a drain assembly for a sink, and more particularly to a drain assembly for an industrial sink that is seamlessly attached to the basin of the sink that it drains.

BACKGROUND

Industrial sinks are often extremely large and deep. These sinks, for safety and practicality reasons, require external (to the sink) manners of operating the drain so that an individual does not have to insert an arm into the sink to release the drain. Moreover, industrial sinks also are found in environments where the accumulation of bacterial, fungal, and other growth is unacceptable. For example, hospitals and cafeteria kitchens should avoid bacterial growth in their sinks to prevent cross-contamination and/or the spread of diseases. Generally, a lip or edge on an industrial sink where the drain assembly is attached to the sink accumulates bacteria, fungi, and other unwanted growths. These lips and edges require additional effort to clean and sanitize.

BRIEF SUMMARY OF THE DISCLOSURE

Briefly described, and according to one embodiment, aspects of the present disclosure generally relate to a drain assembly for a sink (e.g., an industrial sink) that is seamlessly attached to the basin of the sink that it drains. In one embodiment the drain assembly is seamlessly welded to the basin of the sink so that the drain assembly and sink form one continuous unit. One skilled in the art will appreciate that this construction prevents the accumulation/growth of bacteria and fungi in the area of the sink above the sealed-liquid line (e.g., the location at which a drain stopper seals a sink and the sink begins to accumulate/retain liquid) or drain stopper as there is no lip or edge on which bacteria can grow. This seamless construction promotes a more sanitary sink that requires less effort to clean and sanitize.

As will be described in greater detail herein, aspects of the disclosed drain assembly comprises a drain tube, drain stopper, gasket, clamp, and lever. As will be understood, the present disclosure does not impose any limitations on the type or other specifics of the sink to which the drain assembly is attached or the materials of which the drain assembly is composed. The sink and its parts can be made of any material that is durable and allows for a seamless attachment of the drain assembly to the sink (e.g., any common plumbing material such as brass, copper, stainless steel, etc.).

According to an aspect of the present disclosure, the disclosed drain assembly allows for external (to the sink) operation of the drain assembly so that an individual does not have to insert an arm into the sink to release the drain, which in some instances is required by law (e.g., in cafeteria kitchens because it is dangerous for a dishwasher to insert his/her hands into a sink that may contain sharp objects, such as knives), is ill-advised for health reasons (e.g., in hospital sinks where hazardous body fluids could comprise the waste liquid), etc. In various embodiments, this functionality is achieved through the use of a lever that is attached to the drain stopper, wherein moving the lever seals and opens the drain assembly. Further, the lever, in various embodiments, may be removably attached to the drain stopper so that the stopper may be cleaned or sanitized.

In one embodiment, a sink drain assembly comprises: a frustum-shaped drain tube; a semi-spherical drain stopper releasably seated within the frustum-shaped drain tube; and a drain-release lever operatively connected to the semi-spherical drain stopper, wherein a portion of the drain-release lever extends outside of the frustum-shaped drain tube.

According to one aspect of the present disclosure, the sink drain assembly further comprises a linking mechanism releasably attached to a lower portion of the semi-spherical drain stopper and the drain-release lever. Moreover, the linking mechanism comprises a paddle pivotably affixed to the drain-release lever and an upwardly-extending rod releasably attached to the lower portion of the semi-spherical drain stopper. Further, the paddle includes a slot for accepting an end of the drain-release lever. Additionally, the sink drain assembly further comprises a cylindrical tube affixed to a lower circumference of the frustum-shaped drain tube. Also, the cylindrical tube further comprises two or more connector guides engaged with the linking mechanism that guide the linking mechanism in a direction coaxial with the cylindrical tube. Furthermore, the connector guides are oriented on an inner circumferential surface of the cylindrical tube in an axial direction. Additionally, the cylindrical tube further comprises an opening in a circumferential wall wherein the portion of the drain-release lever extends therethrough.

According to one aspect of the present disclosure, the semi-spherical drain stopper further comprises one or more spherical wedge-shaped cut-outs to define a handle portion. Moreover, the spherical wedge-shaped cut-outs each comprise an obtuse angle. Further, the handle portion is located on an upper portion of the semi-spherical drain stopper. Additionally, the semi-spherical drain stopper further comprises an opening that accepts the upwardly extending rod. Also, the lower portion of the semi-spherical drain stopper includes the opening that accepts the upwardly extending rod. Furthermore, the opening and the upwardly extending rod are compatibly threaded to screw together.

According to one aspect of the present disclosure, an upper circumferential edge of the frustum-shaped drain tube is operatively attached to a drain hole in a sink basin. Moreover, the frustum-shaped drain tube is operatively attached to the sink basin via a polished weld that defines a smooth connection between edges of the frustum-shaped drain tube and the sink basin. Additionally, the sink drain assembly further comprises a crown-shaped drain cover. Further, the crown-shaped drain cover includes an upwardly-extending wide lip.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Overview

Figure 1:
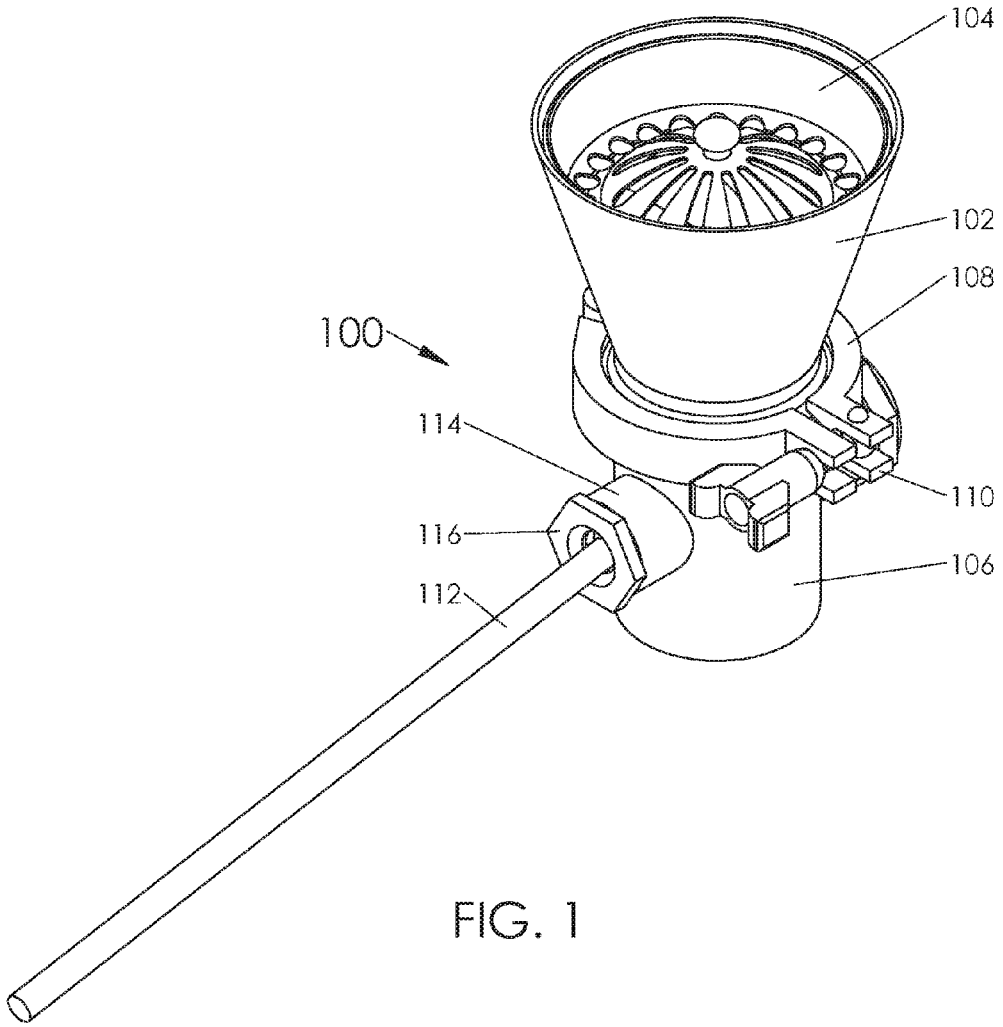
FIG. 1 illustrates a perspective view of an exemplary embodiment of the drain assembly.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether or not a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Aspects of the present disclosure generally relate to a drain assembly for a sink (e.g., an industrial sink) that is seamlessly attached to the basin of the sink that it drains. In one embodiment the drain assembly is seamlessly welded to the basin of the sink so that the drain assembly and sink form one continuous unit. One skilled in the art will appreciate that this construction prevents the accumulation/growth of bacteria and fungi in the area of the sink above the sealed-liquid line (e.g., the location at which a drain stopper seals a sink and the sink begins to accumulate/retain liquid) or drain stopper as there is no lip or edge on which bacteria can grow. This seamless construction promotes a more sanitary sink that requires less effort to clean and sanitize.

As will be described in greater detail herein, aspects of the disclosed drain assembly comprises a drain tube, drain stopper, gasket, clamp, and lever. As will be understood, the present disclosure does not impose any limitations on the type or other specifics of the sink to which the drain assembly is attached or the materials of which the drain assembly is composed. The sink and its parts can be made of any material that is durable and allows for a seamless attachment of the drain assembly to the sink (e.g., any common plumbing material such as brass, copper, stainless steel, etc.).

According to an aspect of the present disclosure, the disclosed drain assembly allows for external (to the sink) operation of the drain assembly so that an individual does not have to insert an arm into the sink to release the drain, which in some instances is required by law (e.g., in cafeteria kitchens because it is dangerous for a dishwasher to insert his/her hands into a sink that may contain sharp objects, such as knives), is ill-advised for health reasons (e.g., in hospital sinks where hazardous body fluids could comprise the waste liquid), etc. In various embodiments, this functionality is achieved through the use of a lever that is attached to the drain stopper, wherein moving the lever seals and opens the drain assembly. Further, the lever, in various embodiments, may be removably attached to the drain stopper so that the stopper may be cleaned or sanitized.

Exemplary Embodiments

Referring now to the figures, FIG. 1 illustrates a perspective view of an exemplary embodiment of the drain assembly 100. The drain assembly 100, generally, provides an outlet for waste liquid from the sink to which it is attached and may be opened and closed from outside of the sink. Details of the drain assembly 100 will be better understood in connection with the discussion of FIGS. 2-5, described in greater detail below.

As shown in FIG. 1, the drain assembly 100 comprises, in one embodiment, a conical drain tube 102 covered by a removable drain cover 104. In various embodiments, the conical drain tube 102 comprises the opening through which the waste liquid from the sink first enters the drain assembly 100. Generally, the conical drain tube 102 comprises a hollow conical frustum, with a larger end oriented towards the basin of the sink (e.g., "top" of the drain assembly 100). In various embodiments, the drain cover 104 comprises a crown-shaped piece with a series of various sized holes that prevent larger objects from entering the conical drain tube 102 while allowing waste liquid to pass through. For example, in a hospital's surgical suite, the drain cover 104 could prevent surgical instruments, such as forceps or scalpels, from accidentally entering the conical drain tube 102; in a cafeteria's kitchen, the drain cover 104 could prevent eating utensils, such as forks and spoons, from accidentally entering the conical drain tube 102, etc. One skilled in the art will appreciate that the drain cover 104 both prevents the loss of valuable items but also prevents large objects that could damage the disclosed drain assembly 100 or clog the drain from entering the conical drain tube 102.

Still referring to FIG. 1, the conical drain tube 102 generally is connected to a cylindrical drain tube 106 by a clamp 108. Generally, the cylindrical drain tube 106 provides an outlet for the disposal of the waste liquid flowing through the drain assembly 100 and connects the drain assembly 100 to the general plumbing of the building in which the sink resides. In one embodiment, the cylindrical drain tube 106 comprises a cross fitting. In one embodiment, the cylindrical drain tube 106 comprises a hollow, cylinder-shaped pipe. The clamp 108, in one embodiment, is held in place by a clamp closure 110. One skilled in the art will appreciate that the clamp 108 and clamp closure 110 can be composed of any material and be in any form or shape that is suitable for holding the cylindrical drain tube 106 to the conical drain tube 102 in such a manner that prevents the escape or leakage of the waste liquid flowing through the drain assembly 100. Further, one skilled in the art will appreciate that the clamp 108 allows the drain assembly 100 to be connected to any shape of drain tube.

In one embodiment, the conical drain tube 102 and the cylindrical drain tube 106 form one single, continuous piece so that a clamp 108 is not necessary to connect the two parts. As will be appreciated by one skilled in the art, the conical drain tube 102 and the cylindrical drain tube 106 may be welded together to form a single piece or forged as a single piece. In various embodiments, the other parts of the drain assembly 100 function in the same manner regardless of whether the conical drain tube 102 and the cylindrical drain tube 106 are one single, continuous piece or are affixed together by the clamp 108.

In one embodiment, a drain-release lever 112 protrudes from the cylindrical drain tube 106 for opening and closing the drain assembly 100 from outside of the sink. Generally, the drain-release lever 112 comprises a thin rod, with or without a handle. One skilled in the art will appreciate that the drain-release lever 112 can be composed of any durable material (e.g., brass, thermoset plastics, stainless steel, etc.). In one embodiment, the drain-release lever 112 protrudes from the cylindrical drain tube 106 through a lever housing 114. Generally, the lever housing 114 comprises a small cylinder attached to the cylindrical drain tube 106 and oriented so that it is perpendicular to the vertical axis of the drain assembly 100. In one embodiment, the lever housing 114 comprises a branch of the cross fitting that has been modified to accept the drain-release lever 112. The drain-release lever 112 is held in place in the lever housing 114 by a lever-housing closure 116. In one embodiment, the lever-housing closure 116 comprises a hexagon bushing affixed to the end of the lever housing 114.

One skilled in the art will appreciate that the drain-release lever 112 allows the drain assembly 100 to be opened and closed from outside the sink, which is advantageous and occasionally necessary for various reasons. For example, in a hospital surgical suite, nurses should not stick their hands into a sink filled with water in which scalpels are soaking to release the drain because they may cut themselves; in a cafeteria kitchen, the sink may be too deep for a dish washer to reach to the bottom of the sink to release the drain, etc. How the drain assembly 100 functions will be explained in more detail in conjunction with the descriptions of FIGS. 2-5.

Figure 2A:
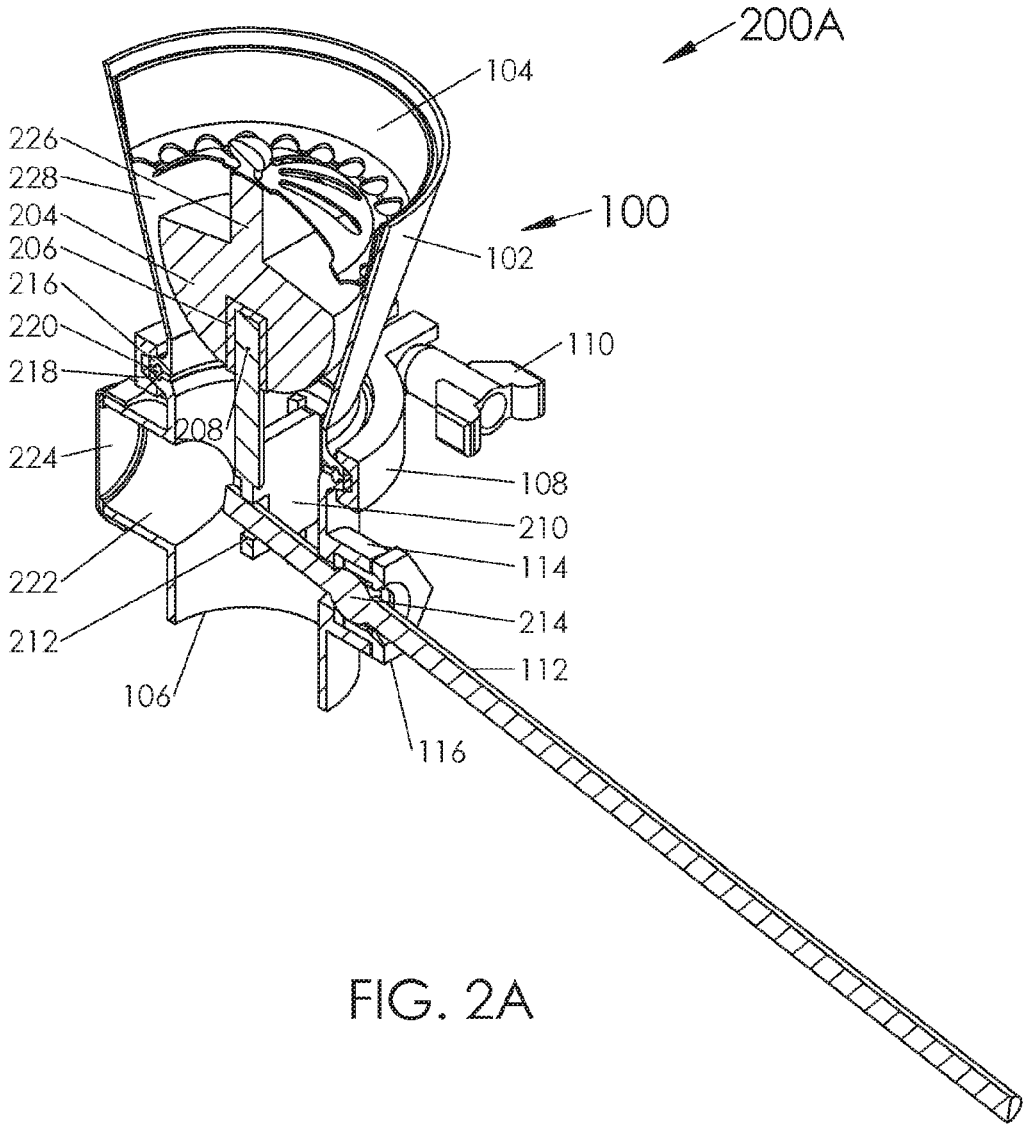
FIG. 2A illustrates a cross-sectional perspective view of an exemplary embodiment of the drain assembly.
Figure 2B:
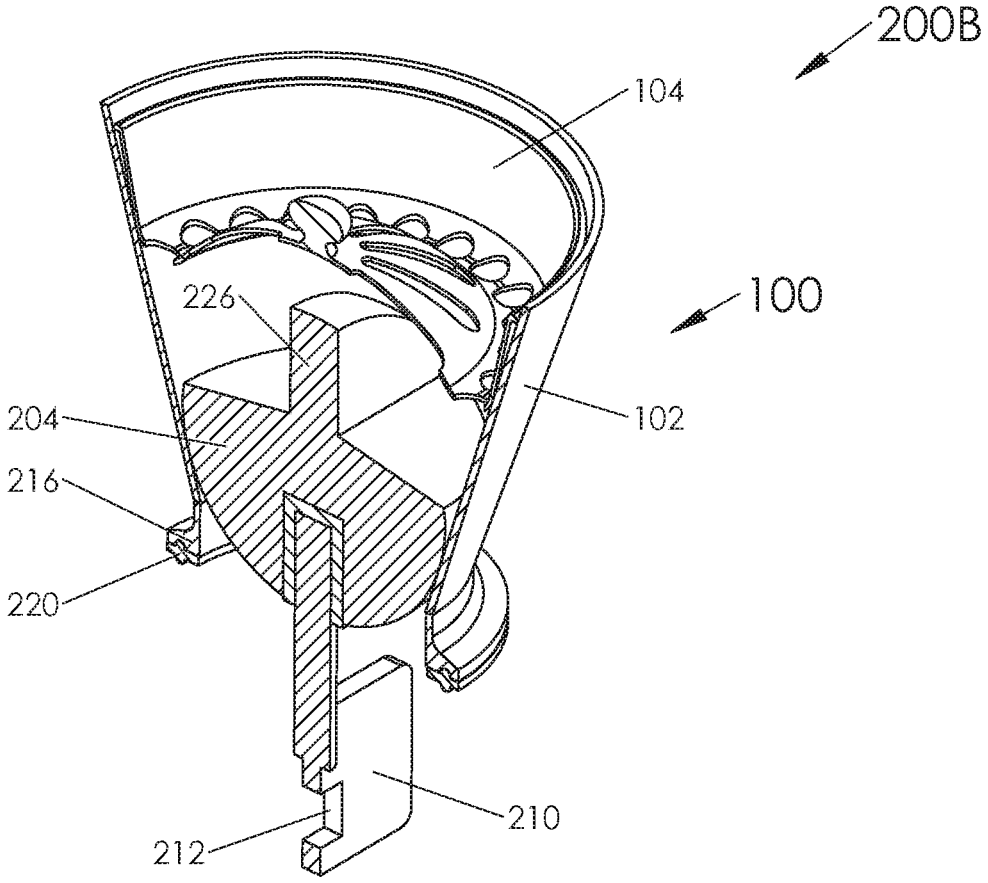
FIG. 2B illustrates a cross-sectional perspective view of an exemplary embodiment of the drain assembly without a lever or cylindrical drain tube.

Now referring to FIG. 2, consisting of FIGS. 2A and 2B, which is an illustration of a perspective, cross-sectional view of an exemplary embodiment of the drain assembly 100. The cross-sections are shown from the perspective of a plane through the vertical axis of the drain assembly 100.

FIG. 2A depicts a cross-section 200A of an exemplary embodiment of the drain assembly 100. As shown, the drain cover 104 comprises a crown-shaped insert with an upwardly-extending wide lip that seats the drain cover 104 within the conical drain tube 102. In one embodiment, the drain cover 104 rests on a drain stopper 204, when the drain stopper 204 is in a raised or open position. Generally, the wide lip prevents the drain cover 104 from moving and allows for the easy insertion/removal of the drain cover 104 from the drain assembly 100. One skilled in the art will appreciate that, while the drain cover 104 in this embodiment of the drain assembly 100 comprises a crown-shaped insert, the drain cover 104 may comprise a thin plate with a series of various sized holes that sits on top of the conical drain tube or any other suitably-shaped drain covering device or mechanism.

Continuing with FIG. 2A, in one embodiment, the drain stopper 204, which will be described in greater detail in connection with the explanation of FIG. 5, is positioned within the conical drain tube 102. Generally, the drain stopper 204 seals the conical drain tube 102 when it is in a closed or seated position to prevent the flow of waste liquid from the sink through the drain assembly 100. In one embodiment, when the drain stopper 204 is in a raised or open position, there is a flow space 228 between the drain stopper 204 and the internal wall of the conical drain tube 102. As will be appreciated by one having ordinary skill in the art, the flow space 228 allows waste liquid to exit the sink through the drain assembly 100. In one embodiment, to increase the flow rate of the waste liquid through the drain assembly 100, the size of the flow space 228 is increased. In one embodiment, to decrease the flow rate of the waste liquid through the drain assembly 100, the size of the flow space 228 is decreased. In one embodiment, the flow space 228 is 0.25" in width at its narrowest point between the drain stopper 204 and conical drain tube 106.

According to various embodiments, the drain stopper 204 comprises a rubber hemisphere with a disc-shaped handle 226 extending perpendicular to the hemisphere. In one embodiment, the rounded shape of the drain stopper 204 allows it to seal the conical drain tube 102 and prevent water from flowing through the drain assembly 100. Generally, the drain stopper 204 is removably attached via stopper threading 206 on the drain stopper 204 to a stopper connector 208, which provides an anchor point for the drain stopper 204. In various embodiments, the stopper connector 208 According to one embodiment, the stopper threading 206 is on the interior edges of a cylindrical hole that is located in the center of the bottom of the drain stopper 204, opposite the disc-shaped handle 226. One skilled in the art will appreciate that the stopper threading 206 allows the drain stopper 204 to be easily removed, by use of the disc-shaped handle 226 to unscrew the drain stopper 204 from the stopper connector 208, for cleaning, repair, or replacement without disassembling the drain assembly 100 (e.g., the drain stopper 204 can be removed from the drain assembly 100 without removing any other part of the drain assembly 100, except for the drain cover 104). Generally, the stopper connector 208 comprises a cylinder with threads on its exterior edges that fits within the cylindrical hole that is located in the center of the bottom of the drain stopper 204 and mates with the stopper threading 206. In various embodiments, the stopper connector 208 is attached to a linking mechanism that operatively connects the drain stopper 204 to the drain-release lever 112. In one embodiment, the stopper connector 208 is attached to a connector paddle 210 that is oriented parallel to the vertical axis of the drain assembly 100 and allows for substantially vertical movement of the connector paddle 210 (and, consequently, the stopper connector 208 and drain stopper 204). In certain embodiments, the connector paddle 210 comprises a cuboid with height and width exceeding its depth to create a rectangular prism shape. In one embodiment, the connector paddle 210 is operatively connected to the lever 112 to enable movement of the connector paddle 210 (and, consequently, the drain stopper 204) by movement of the drain-release lever 112. In one embodiment, the connector paddle 210 contains a connector slot 212, which comprises a small rectangular-shaped hole in the largest vertically-oriented face of the connector paddle 210 that accepts the end of the drain-release lever 112 and allows the drain-release lever 112 to actuate the drain stopper 204. In various embodiments, the stopper connector 208 is connected to the connector paddle 210 directly above the connector slot 212.

In one embodiment, the drain stopper 204, stopper connector 208, and connector paddle 210 form one single, continuous piece so that the stopper threading 206 is not necessary to connect the parts. As will be appreciated by one skilled in the art, the drain stopper 204, stopper connector 208, and connector paddle 210 may be welded together to form a single piece or forged as a single piece. In various embodiments, the other parts of the drain assembly 100 function in the same manner regardless of whether the drain stopper 204, stopper connector 208, and connector paddle 210 are one single, continuous piece or are affixed together by the stopper threading 206.

According to one embodiment, the drain-release lever 112 extends from the lever housing 114 into the connector slot 212. The drain-release lever 112 generally contains a lever pivot ball 214, which acts as a fulcrum for the drain-release lever 112. In one embodiment, the lever pivot ball 214 sits within the lever housing 114 and is spherically shaped. One skilled in the art will appreciate that the lever pivot ball 214 allows the drain-release lever 112 to easily move up and down with the application of force to the exterior (to the drain assembly 100) end of the drain-release lever 112. Generally, because of the fulcrum-like connection between the lever 112 and connector paddle 210, when the drain-release lever 112 moves up and down, the connector paddle 210, and therefore the connected drain stopper 204, also moves up and down. One skilled in the art will appreciate that this up and down movement of the drain stopper 204 seals and opens the drain assembly 100 so that liquid is held in the sink above the drain assembly 100 and waste liquid flows through the drain assembly 100, respectively. Generally, the drain stopper 204 seals the conical drain tube 102 when it is a closed or seated position to prevent the flow of waste liquid from the sink through the drain assembly 100. In one embodiment, when the drain stopper 204 is in a raised or open position, there is a flow space 228 between the drain stopper 204 and the internal wall of the conical drain tube 102. As will be appreciated by one having ordinary skill in the art, the flow space 228 allows waste liquid to exit the sink through the drain assembly 100.

In various embodiments, the narrow end of the conical drain tube 102 flares out to form a conical drain tube lip 216. In one embodiment, the conical drain tube lip 216 is perpendicular to the central, vertical axis of the conical drain tube 102 and provides a means for attaching the conical drain tube 102 to the cylindrical drain tube 106. Generally, the top of the cylindrical drain tube 106, closest to the conical drain tube 102, flares out to form a cylindrical drain tube lip 218. In one embodiment, the cylindrical drain tube lip 218 is perpendicular to the central, vertical axis of the cylindrical drain tube 106 and provides a means for attaching to the conical drain tube 102. To create a watertight seal, in one embodiment, a drain tube gasket 220 sits between the conical drain tube lip 216 and the cylindrical drain tube lip 218. One skilled in the art will appreciate that the drain tube gasket 220 may comprise any material (e.g., rubber, silicone, urethane, or any other durable/flexible material) or shape that will sit between the conical drain tube lip 216 and the cylindrical drain tube lip 218 and sufficiently prevent water from escaping the drain assembly 100. Generally, the clamp 108 fits around the conical drain tube lip 216 and cylindrical drain tube lip 218, with the drain tube gasket 220 in between the two lips, to hold the conical drain tube 102 and cylindrical drain tube 106 together and form a watertight seal.

Still referring to FIG. 2A, the cylindrical drain tube 106, in one embodiment, contains an auxiliary drain tube 222 opposite the lever housing 114. One skilled in the art will appreciate that the auxiliary drain tube 222 can accept various inputs including, but not limited to, a pipe that connects to another drain assembly 100 for another sink or a garbage disposal attached beneath another sink. Generally, the inputs also contribute waste liquid to the drain assembly 100. According to one embodiment, the auxiliary drain tube 222 comprises a small, hollow cylinder attached to the cylindrical drain tube 106 and oriented so that it is perpendicular to the vertical axis of the drain assembly 100 and opposite the lever housing 114. In one embodiment, the auxiliary drain tube 222 comprises a branch of the cross fitting that is opposite the lever housing 114. The auxiliary drain tube 222 can, in various embodiments, be sealed by the auxiliary drain tube cover 224, which can be a cap or plug made of any material that is compatible with the auxiliary drain tube 222.

Referring now to FIG. 2B, a cross-section 200B of an exemplary embodiment of the drain assembly 100 is shown. As shown, the embodiment in FIG. 2B is similar to the embodiment shown in FIG. 2A, except that FIG. 2B shows the drain stopper 204 in a seated or closed position and does not show any of the parts of the drain assembly 100 below the conical drain tube lip 214. Accordingly, the discussion of FIG. 2A also applies to FIG. 2B, except that no flow space 228 exists because the drain stopper 204 is in a seated or closed position that prevents the flow of waste liquid from the sink through the drain assembly 100. Thus, in one embodiment, in the seated or closed position as shown in FIG. 2B, the drain assembly 100 does not accept waste liquid and instead the waste liquid accumulates in the sink above the drain assembly. To further understand the drain assembly 100, a discussion of the drain assembly 100 in the context of its attachment to a sink basin may be useful.

Figure 3:
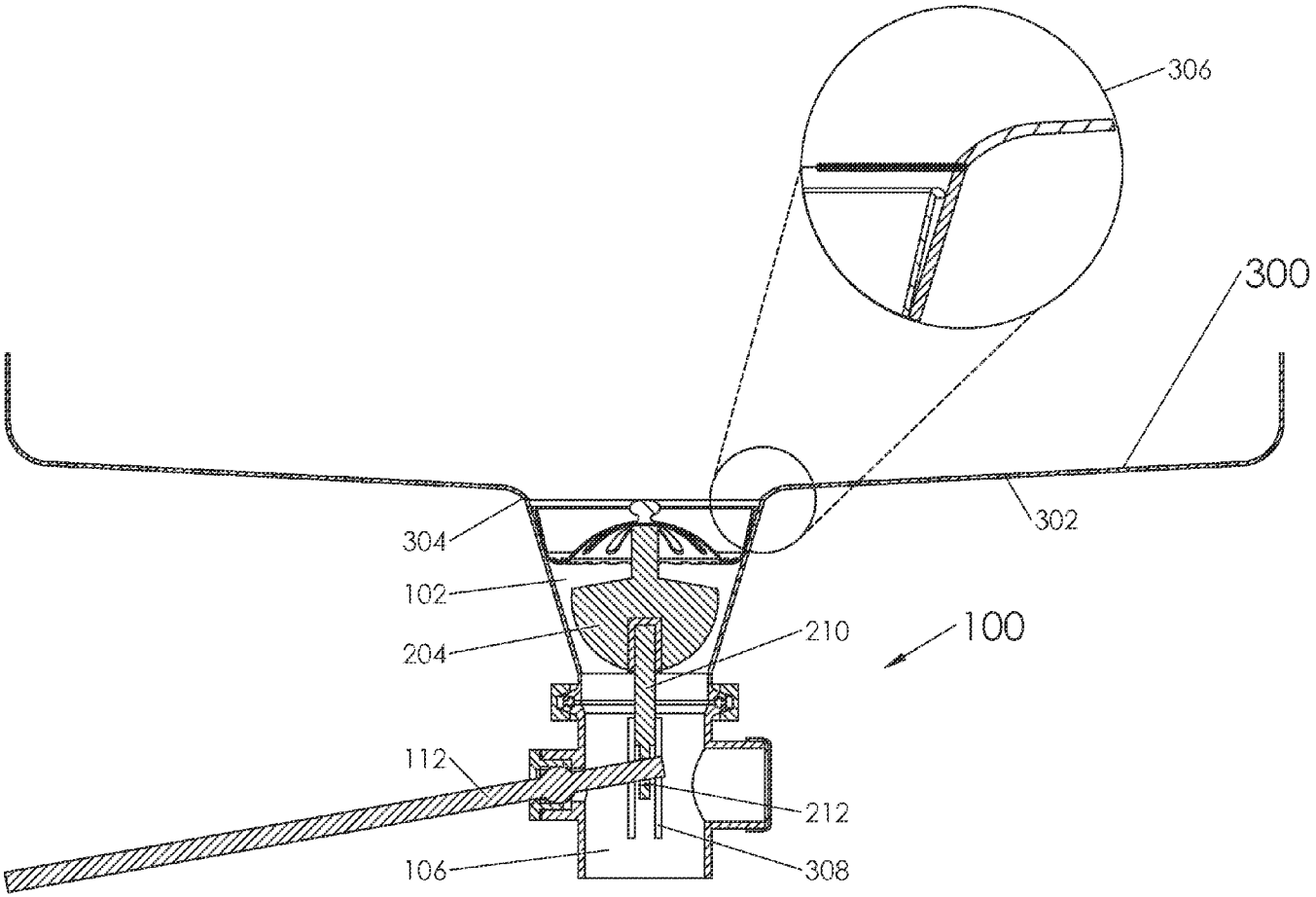
FIG. 3 illustrates a cross-sectional view of an exemplary embodiment of the drain assembly when affixed to a sink basin.

Now referring to FIG. 3, a cross-section 300 of an exemplary embodiment of the drain assembly 100 attached to a sink basin 302 is shown. The cross-section is taken from the perspective of a plane through the vertical axis of the drain assembly 100.

According to one embodiment, the drain assembly 100 is attached to a sink basin 302 so that no seam, edge, or flange is left at the drain weld 304 or place of attachment. Generally, this smooth attachment is accomplished by welding, using standard welding techniques and materials, the conical drain tube 102 to the sink basin 302, and then smoothing and polishing the drain weld 304 so that the transition between sink basin 302 and conical drain tube 102 has no physical difference and functions as if the sink basin 302 and conical drain tube 102 were made in one piece. Generally, this smooth attachment, which can be seen in greater detail in the expanded view 306 of the drain weld 304, provides no seam, edge, or flange in the sink basin above where the drain stopper 204 seals the drain assembly 100. One skilled in the art will appreciate that this lack of seam or flange prevents growth of bacteria or fungi because there exists no place for the bacteria or fungi to grow, resulting in a more sanitary sink. For example, in a hospital's surgical suite, a sink fitted with the disclosed drain assembly 100 will not accumulate bacteria that washes off of a surgeon's hand after surgery; in a cafeteria's kitchen, a sink fitted with the disclosed drain assembly 100 will not accumulate bacteria from food waste washed down the drain assembly.

In one embodiment, the sink assembly 100 includes an external (to the sink basin 302) means for operating the drain assembly 100 (e.g., a button that actuates a motor that raises and lowers the drain stopper 204, a crank assembly that raises and lowers the drain stopper 204, etc.). Accordingly, in one embodiment, the drain-release lever 112 allows the disclosed drain assembly 100 to be operated without inserting a hand into the sink basin 302. In one embodiment, the connector paddle 210, which is attached to the drain stopper 204 and allows the drain-release lever 112 to move the drain stopper 204, sits in a connector guide 308 on the interior walls of the cylindrical drain tube 106. The connector guides 308, generally, prevent the connector paddle 210 from moving in a manner that does not raise or lower the drain stopper 204 and also prevent the drain-release lever 112 from slipping out of the connector slot 212. Thus, in one embodiment, the width of the connector paddle 210 is in proportion to the interior-diameter of the cylindrical drain tube 106 so that the connector paddle 210 extends from within one connector guide 308 to the other. Further, in one embodiment, the height of the connector paddle 210 is such that it does not leave the length of the connector guide 308 as it moves up and down. In one embodiment, the connector guide 308 comprises a channel oriented parallel to the vertical axis of the cylindrical drain tube 106, and the walls of the connector guide 308 protrude from the interior surface of the cylindrical drain tube 106. In various embodiments, there are two connector guides 308 on opposite sides of the interior surface of the cylindrical drain tube 106. One skilled in the art will appreciate that the connector guide 308 can also be, in various embodiments, cut into the interior wall of the cylindrical drain tube 106 and that the dimensions of the connector paddle 210 would be modified accordingly.

According to one embodiment, the drain assembly 100 is centrally-affixed below a sink basin 302 that is made of stainless steel and is built to NSF #2 standards, with a 0.5" pitch. In one embodiment, the conical drain tube 102 has a 4.5" interior diameter at its largest circumference, which is located at the drain weld 304 between the conical drain tube 102 and the sink basin 302. In one embodiment, the conical drain tube 102 has a 2.5" interior diameter at its smallest circumference, which is located where the conical drain tube 102 is affixed to the cylindrical drain tube 106. In one embodiment, the drain weld 304 is fully polished on both the inside and outside surfaces and is 0.0625" from the bottom of the sink basin 302, which has a 0.75" formed radius towards the drain weld 304. The drain stopper 204, in one embodiment, sits within the conical drain tube 102 and seals the drain assembly 100 so that the sealed-liquid line within the sink is below the drain weld 304 but above the top of the cylindrical drain tube 106. In one embodiment, the cylindrical drain tube 106 has an interior diameter of 2.375" and an exterior diameter of 2.5". In one embodiment, the connector paddle 210, connector slot 212, drain-release lever 112, etc. are connected below the drain stopper 204 and within the cylindrical drain tube 106 (e.g., not above the sealed-liquid line, which comprises the location at which a drain stopper seals a sink and the sink begins to accumulate/retain liquid). Generally, when in a raised or open position, waste liquid flows from the sink basin 302 into the conical drain tube 102, past the drain stopper 204, and into the cylindrical drain tube 106. Generally, when in a seated or closed position, liquid sits in the sink basin 302 and conical drain tube 102 above the drain stopper 204, and waste liquid does not flow past the drain stopper 204 into the cylindrical drain tube 106.

Figure 4:
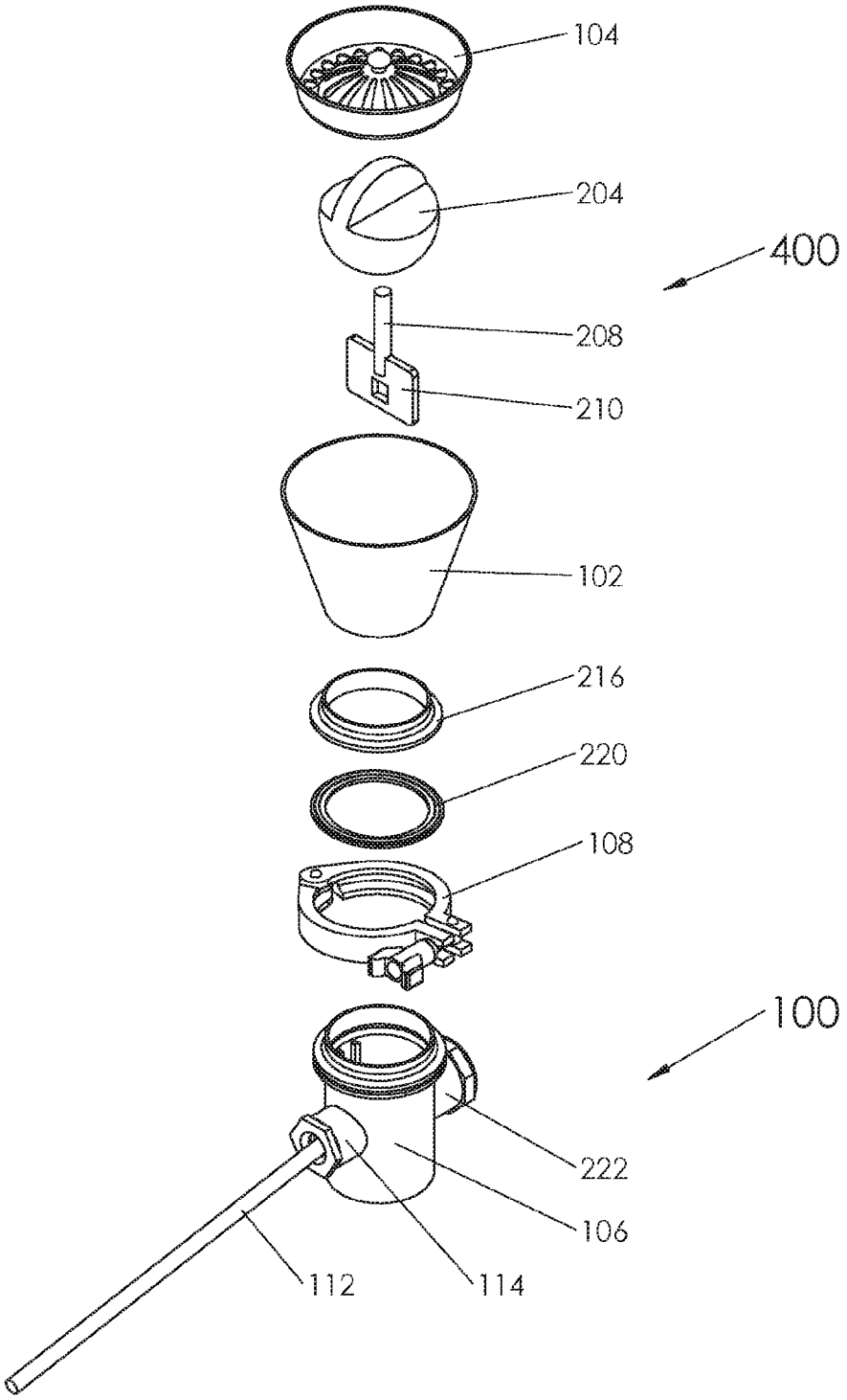
FIG. 4 illustrates an exploded view of an exemplary embodiment of the drain assembly.

Referring now to FIG. 4, an exploded view 400 of an exemplary embodiment of the drain assembly 100 is shown. The exploded view 400 is shown along the vertical axis of the drain assembly 100.

In one embodiment, a drain cover 104 sits on top of the drain assembly 100. Further, a drain stopper 204, which is attached via a stopper connector 208 to a connector paddle 210, sits within a conical drain tube 102. According to one embodiment, a conical drain tube lip 216 is seperably attached to the bottom of the conical drain tube 102. In various embodiments, the conical drain tube lip 216 is seamlessly attached to the bottom of the conical drain tube 102 so that the conical drain tube lip 216 and conical drain tube 102 form one continuous unit. Below the conical drain tube 102 and conical drain tube lip 216 is a cylindrical drain tube 106, which, in various embodiments, contains a drain-release lever 112 in a lever housing 114 and an auxiliary drain tube 222. According to various embodiments, between the conical drain tube 102 and the cylindrical drain tube 106 sits a drain tube gasket 220. Generally, a clamp 108 fits over the juncture of the conical drain tube 102 and the cylindrical drain tube 106 and holds the two tightly together so that the drain tube gasket 220 seals the drain assembly 100 and prevents waste liquid from escaping/leaking out of the drain assembly 100.

Figure 5A:
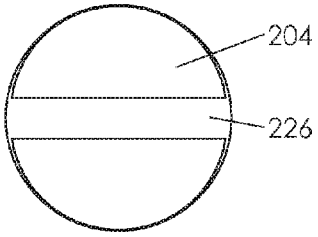
FIG. 5 (comprising FIGS. 5A-5D) illustrates several views of a drain stopper from an exemplary embodiment of the drain assembly.
Figure 5C:
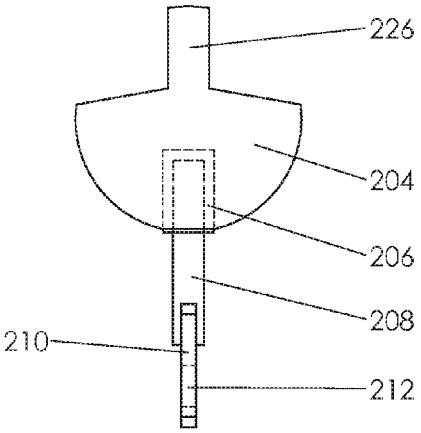
Figure 5B:
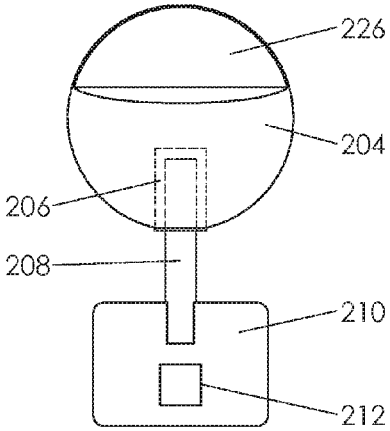
Figure 5D:
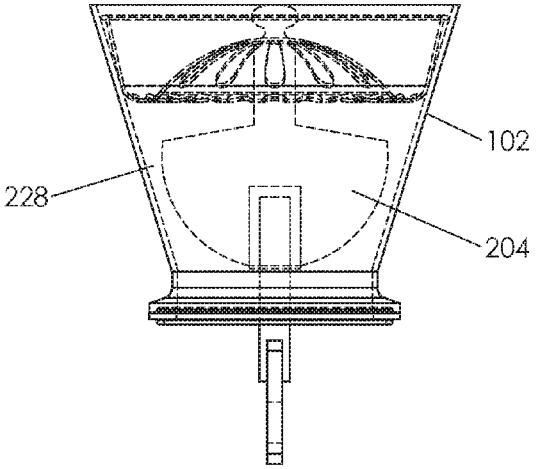

Now referring to FIG. 5, consisting of FIGS. 5A, 5B, 5C, and 5D, which is an illustration of several views of a drain stopper 204 from an exemplary embodiment of the drain assembly 100. FIG. 5A shows a top view of the drain stopper 204. FIG. 5B shows a side view of the drain stopper 204 attached the connector paddle 210. FIG. 5C shows a side view, rotated 90° in comparison to FIG. 5B, of the drain stopper 204 attached the connector paddle 210. FIG. 5D shows the drain stopper 204 within a conical drain tube 102.

Still referring to FIG. 5, the drain stopper 204 generally comprises a rubber sphere with two identical spherical wedges removed from the opposite sides of the top of the sphere to form a disc-shaped handle 226 for gripping and easily removing the drain stopper 204 from the stopper connector 208. The spherical wedges, in one embodiment, prevent waste liquid from sitting on the drain stopper 204 and are each less than 25% of the volume of the sphere of the rubber sphere that forms the drain stopper 204. In one embodiment, one edge of the spherical wedge is parallel to a vertical axis running through the drain stopper 204. In one embodiment, the other edge of the spherical wedge forms an obtuse angle with the first edge. Generally, the rounded edge of the drain stopper 204 is oriented towards the narrow end of the conical drain tube 102 (e.g., so that the disc-shaped handle 226 faces the larger end of the conical drain tube 102). This orientation allows the spherical end of the drain stopper 204 to seal the drain assembly 100 and prevent the flow of waste liquid through the drain assembly 100.

According to one embodiment, the drain stopper 204 comprises a disc-shaped handle 226 that is 1" tall and 0.5" wide. In one embodiment, a 100° angle comprises the spherical wedges that form the disc-shaped handle 226; thus, in one embodiment, the distance between the disc-shaped handle 226 and the edge of the drain stopper 204 is 1.125". In one embodiment, the stopper threading 206 extends 1" into the drain stopper 204 and is 0.625" in diameter; thus, in one embodiment, the portion of the stopper connector 208 that extends into the drain stopper 204 comprises 0.875" in length and 0.375" in width. In one embodiment, the connector paddle 210 is 0.1875" in width.

As will be appreciated by one having ordinary skill in the art, the drain stopper 204, in one embodiment, may be frustum-shaped instead of spherical. In one embodiment, the drain stopper 204 may be disc-shaped instead of spherical. According to various embodiments, the drain stopper 204 may include a gasket that ensures that the flow space 228 is properly sealed to prevent the flow of waste liquid.

The foregoing description of the exemplary embodiments has been presented only for the purposes of illustration and description and is not intended to be exhaustive or to limit the inventions to the precise forms disclosed. Many modifications and variations are possible in light of the above teaching.

The embodiments were chosen and described in order to explain the principles of the inventions and their practical application so as to enable others skilled in the art to utilize the inventions and various embodiments and with various modifications as are suited to the particular use contemplated. Alternative embodiments will become apparent to those skilled in the art to which the present inventions pertain without departing from their spirit and scope. Accordingly, the scope of the present inventions is defined by the appended claims rather than the foregoing description and the exemplary embodiments described therein.

What is claimed is:

1. A sink drain assembly, comprising:

a frustum-shaped drain tube;

a semi-spherical drain stopper releasably seated within the frustum-shaped drain tube;

a drain-release lever operatively connected to the semi-spherical drain stopper, wherein a portion of the drain-release lever extends outside of the frustum-shaped drain tube; and a linking mechanism releasably attached to a lower portion of the semi-spherical drain stopper and the drain-release lever.

2. The sink drain assembly of claim 1, wherein the linking mechanism comprises a paddle pivotably affixed to the drain-release lever and an upwardly-extending rod releasably attached to the lower portion of the semi-spherical drain stopper.

3. The sink drain assembly of claim 2, wherein the paddle includes a slot for accepting an end of the drain-release lever.

4. The sink drain assembly of claim 3, further comprising a cylindrical tube affixed to a lower circumference of the frustum-shaped drain tube.

5. The sink drain assembly of claim 4, wherein the cylindrical tube further comprises two or more connector guides engaged with the linking mechanism that guide the linking mechanism in a direction coaxial with the cylindrical tube.

6. The sink drain assembly of claim 5, wherein the connector guides are oriented on an inner circumferential surface of the cylindrical tube in an axial direction.

7. The sink drain assembly of claim 4, wherein the cylindrical tube further comprises an opening in a circumferential wall wherein the portion of the drain-release lever extends therethrough.

8. The sink drain assembly of claim 2, wherein the semi-spherical drain stopper further comprises one or more spherical wedge-shaped cut-outs to define a handle portion.

9. The sink drain assembly of claim 8, wherein the spherical wedge-shaped cut-outs each comprise an obtuse angle.

10. The sink drain assembly of claim 8, wherein the handle portion is located on an upper portion of the semi-spherical drain stopper.

11. The sink drain assembly of claim 2, wherein the semi-spherical drain stopper further comprises an opening that accepts the upwardly extending rod.

12. The sink drain assembly of claim 11, wherein the lower portion of the semi-spherical drain stopper includes the opening that accepts the upwardly extending rod.

13. The sink drain assembly of claim 11, wherein the opening and the upwardly extending rod are compatibly threaded to screw together.

14. The sink drain assembly of claim 1, wherein an upper circumferential edge of the frustum-shaped drain tube is operatively attached to a drain hole in a sink basin.

15. The sink drain assembly of claim 14, wherein the frustum-shaped drain tube is operatively attached to the sink basin via a polished weld that defines a smooth connection between edges of the frustum-shaped drain tube and the sink basin.

16. The sink drain assembly of claim 1, further comprising a crown-shaped drain cover.

17. The sink drain assembly of claim 16, wherein the crown-shaped drain cover includes an upwardly-extending wide lip.

* * * * *